United States Patent [19]

König et al.

[11] Patent Number: 4,622,783

[45] Date of Patent: Nov. 18, 1986

[54] ARRANGEMENT FOR FASTENING A GRINDING DISK ON A ROTATABLE GRINDING PLATE OF A GRINDING APPARATUS

[75] Inventors: Dieter König; Heinz Schickhaus, both of Munich; Johann Müller, Ismaning, all of Fed. Rep. of Germany

[73] Assignee: Bayerische Motoren Werke Aktiengesellschaft, Munich, Fed. Rep. of Germany

[21] Appl. No.: 829,556

[22] Filed: Feb. 14, 1986

Related U.S. Application Data

[63] Continuation of Ser. No. 615,816, May 31, 1984, abandoned.

[30] Foreign Application Priority Data

Jun. 1, 1983 [DE] Fed. Rep. of Germany ..... 3319925

[51] Int. Cl.[4] ..... B24D 9/08

[52] U.S. Cl. ..... 51/376; 51/382

[58] Field of Search ..... 51/358, 376, 377, 378, 51/379, 389, 382, 388, 383, 386, 387

[56] References Cited

U.S. PATENT DOCUMENTS

| | | | |
|---|---|---|---|
| 871,964 | 11/1907 | Stewart | 51/377 |
| 2,447,102 | 8/1948 | Strand | 51/383 X |
| 2,454,726 | 11/1948 | Tott | 51/379 |
| 2,501,554 | 3/1950 | Watson | 51/378 |
| 2,620,605 | 12/1952 | Holford | 51/377 |
| 2,719,389 | 10/1955 | Singley . | |
| 2,789,402 | 4/1957 | Tocci-Guilbert et al. | 51/377 |
| 2,800,752 | 7/1957 | Short | 51/376 |
| 3,092,937 | 6/1963 | Tocci-Guilbert | 51/377 |
| 3,376,675 | 4/1968 | Hutchins | 51/376 |
| 4,287,685 | 9/1981 | Marton | 51/382 X |

*Primary Examiner*—Robert P. Olszewski

*Attorney, Agent, or Firm*—Barnes & Thornburg

[57] ABSTRACT

An installation for fastening a grinding sheet on a rotatable grinding disk of a grinding apparatus. The fastening is realized by clamping elements which are rotatably retained with respect to the grinding disk and the grinding apparatus. As a result thereof, the grinding sheet can rotate independently of the grinding disk. Grinding apparatus on which the grinding sheets are secured in the manner described, can be utilized in the automobile industry for rubbing down automobile bodies.

17 Claims, 13 Drawing Figures

FIG. 3
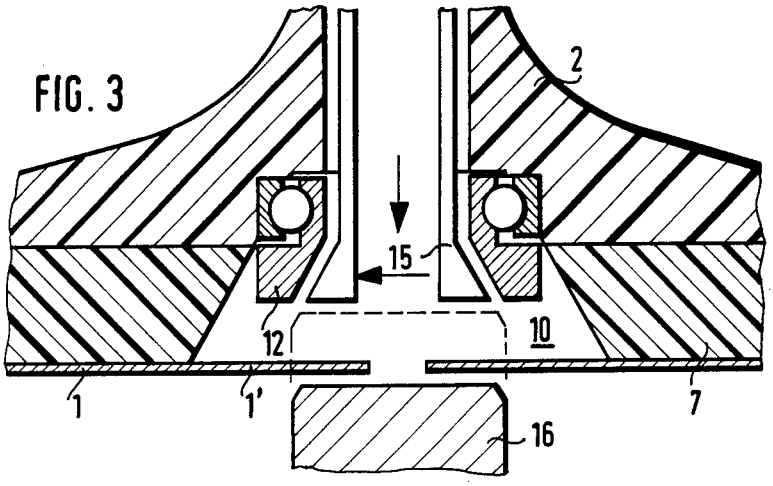
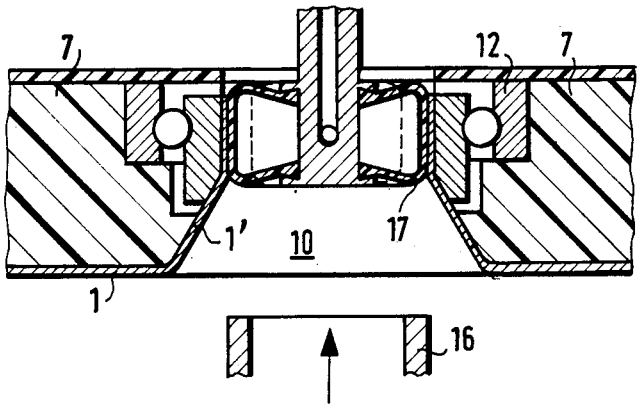
FIG. 4
FIG. 5
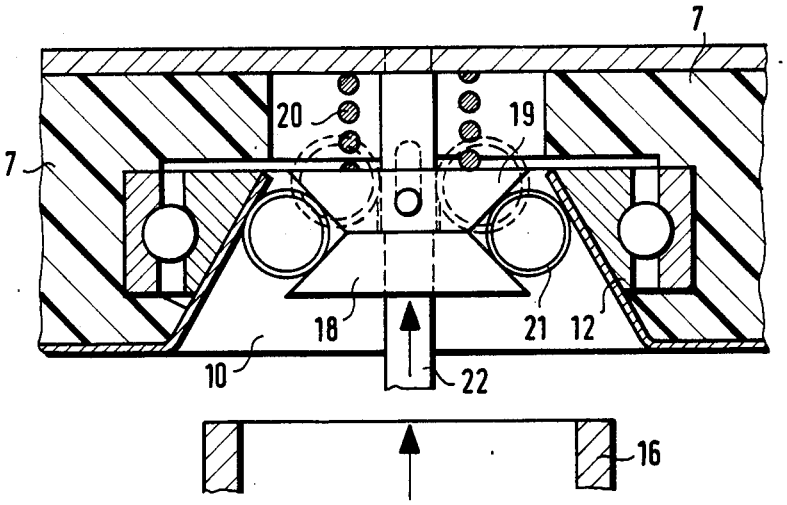

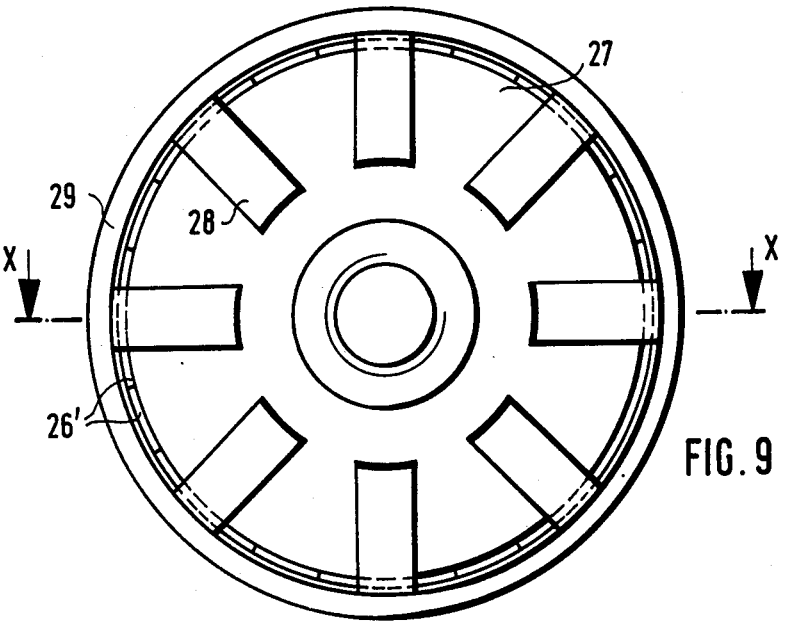
FIG. 9
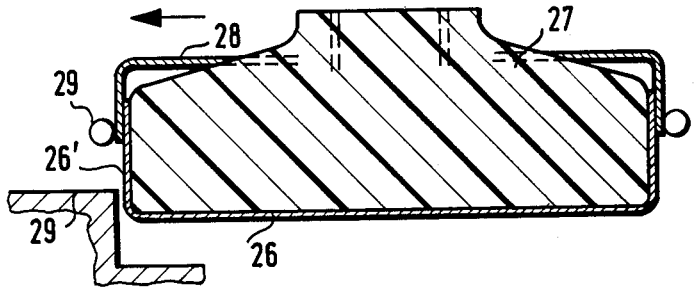
FIG. 10
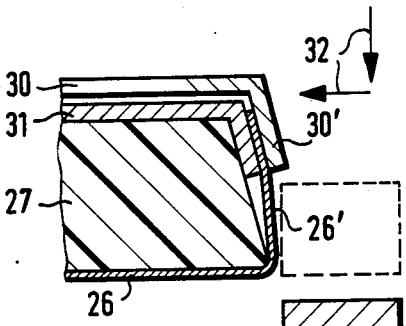
FIG. 11
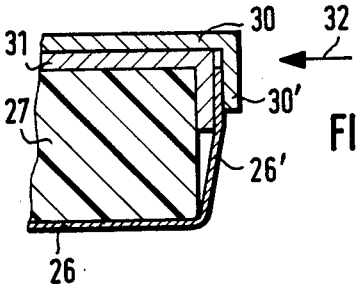
FIG. 12
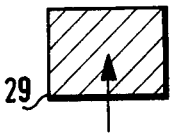
FIG. 13
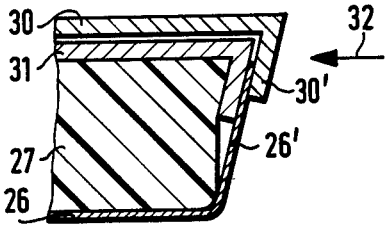

ARRANGEMENT FOR FASTENING A GRINDING DISK ON A ROTATABLE GRINDING PLATE OF A GRINDING APPARATUS

This is a continuation of application Ser. No. 615,816 filed May 31, 1984, now abandoned.

BACKGROUND OF THE INVENTION

The present invention relates to an arrangement for the fastening of a grinding sheet at a rotatable grinding wheel or disk of a grinding apparatus, in which the grinding sheet includes flexible fastening lugs or tabs and is adapted to be fixed at the grinding wheel or disk by means of clamping elements by way of these fastening tabs or lugs.

During the painting of automobile bodies, at first the corresponding body parts are provided with a primer or filler. This primer coating must be smoothed out by rubbing down before the cover paint coat, properly speaking, can be applied. The rubbing down is realized by means of grinding apparatus which include a rotating grinding disk and a grinding sheet arranged thereat. As a rule, the grinding apparatus are manually guided by an operator over the surfaces to be rubbed down and smoothed out. In case of a wet grinding operation, the grinding sheets are thereby not secured at the grinding disk. If during the rubbing down operation the grinding sheet should be displaced with respect to the grinding disk, then the operator can easily correct the same.

However, if one seeks to automate the grinding or rubbing-down operation, i.e., if the grinding apparatus is to be guided by an automatic machine, the grinding sheet has to be necessarily secured at the grinding disk. The same is true, as to the rest, also in case of a dry grinding operation, in which the grinding sheet does not adhere at the grinding disk, as during the wet grinding operation, by reason of adhesion forces. However, it has been found that during the grinding or rubbing-down operation, the grinding sheet exhibits a slippage with respect to the rotation of the grinding disk. With a fixed grinding sheet, this slippage becomes disadvantageous. It leads to warpings and deformations of the grinding sheet and therewith to surfaces that are not rubbed-down and smoothed-out neatly.

SUMMARY OF THE INVENTION

Accordingly, it is the object of the present invention to so secure the grinding sheet in a grinding apparatus of the type described above that the slippage in the rotation between the grinding disk and the grinding sheet can no longer become effective.

The underlying problems are solved according to the present invention in that the clamping elements arranged at the grinding disk, respectively, at the grinding apparatus, retain the secured grinding sheet relatively rotatable with respect to the grinding disk.

As a result of these measures, the grinding sheet is able to rotate relative to, possibly slower than, the grinding disk. Consequently, it no longer has to become warped and can rest always with its entire surface on the surface to be rubbed-down and polished. This produces smooth ground surfaces of the primer material, respectively, filler which again is prerequisite for a good optical impression of the cover paint applied over the same.

Since such grinding apparatus according to the present invention are guided primarily by an automated machine, it is a further requirement of the present invention to so construct the clamping elements that an automatic clamping of the grinding sheet is possible.

The underlying problems are solved in that respect by means to be discussed more fully hereinafter. However, two main groups have to be differentiated in connection therewith. On the one hand, the grinding sheet is provided along its circumference with the fastening tabs or lugs which are secured correspondingly at the outer edge of the grinding disk. With the second main group, the clamping of the grinding sheet takes place in the center area. This offers the advantage that a heretofore customary grinding sheet can be used for that purpose, which is provided with the fastening lugs or tabs by star-shaped slots. In contrast thereto, grinding sheets are required in the case of an outer clamping arrangement, which are larger in diameter by the length of the fastening tabs or lugs. With the very large number of such grinding sheets, as are used in the automobile industry, this becomes a significant factor in the cost thereof. Even though with grinding sheets secured in the center thereof, parts of the grinding sheet are in effect removed from the grinding action. These areas contribute only little to the grinding performance. In fact, the thereby reduced grinding performance of the grinding sheet is hardly noticeable.

With the fastening of the grinding sheet in its center area, it is advantageous if the counter-abutment, also forming part of the clamping element, is rotatably retained at the grinding disk or at a part secured to the grinding disk by way of a roller bearing. In lieu of the roller bearing, also a slide bearing can be used; however, the proper functioning might not always be assured in that case by reason of the strong dirt developments during the grinding operation.

With the automatic fastening, the grinding sheet is located in an interchange station. The grinding apparatus is lowered over the grinding sheet until the grinding disk rests flush on the grinding sheet. The fastening lugs are then uprighted and are clamped-in between pressure elements and counter-abutment. During the fastening in the center area of the grinding sheet, the uprighting of the fastening lugs is taken over by a hollow cylinder which is guided most appropriately in the interchange station. The pressure element is actuated in an advantageous embodiment by the grinding apparatus itself.

In a particularly advantageous construction of the present invention, the pressure element also takes over the erecting of the fastening lugs. The hollow cylinder in the interchange station can be dispensed with in that case.

If the pressure element is actuated by the grinding apparatus, care must always be taken that it is rotatably retained with respect to the same. This requires a certain structural expenditure. In order to avoid the same, in a further advantageous embodiment of the present invention, the pressure element is introduced in the interchange station from below into the grinding disk. The pressure element is then kept at the counter-abutment in the clamping position by a snap-in connection or by magnetic forces or in any other known manner.

In order to compensate for tolerances, it is appropriate to construct the clamping area elastically. This can take place by rubber supports at the counter-abutment or at the pressure element or at both clamping elements.

BRIEF DESCRIPTION OF THE INVENTION

These and further objects, features and advantages of the present invention will become more apparent from the following description when taken in connection with the accompanying drawing which shows, for purposes of illustration only, several embodiments in accordance with the present invention, and wherein:

FIGS. 3, 4 and 5 are partial cross-sectional views through further modified embodiments of the lower section of a grinding apparatus for the fastening of the grinding sheet in accordance with the present invention;

FIG. 9 is a plan view for the outside fastening of the grinding sheet in accordance with the present invention;

FIG. 10 is a cross-sectional view taken along line X—X of FIG. 9; and

FIGS. 11, 12 and 13 are partial cross-sectional views through three further embodiments for the external fastening of the grinding sheet in accordance with the present invention.

DETAILED DESCRIPTION OF THE PREFERRED EMBODIMENTS

Figure 1:
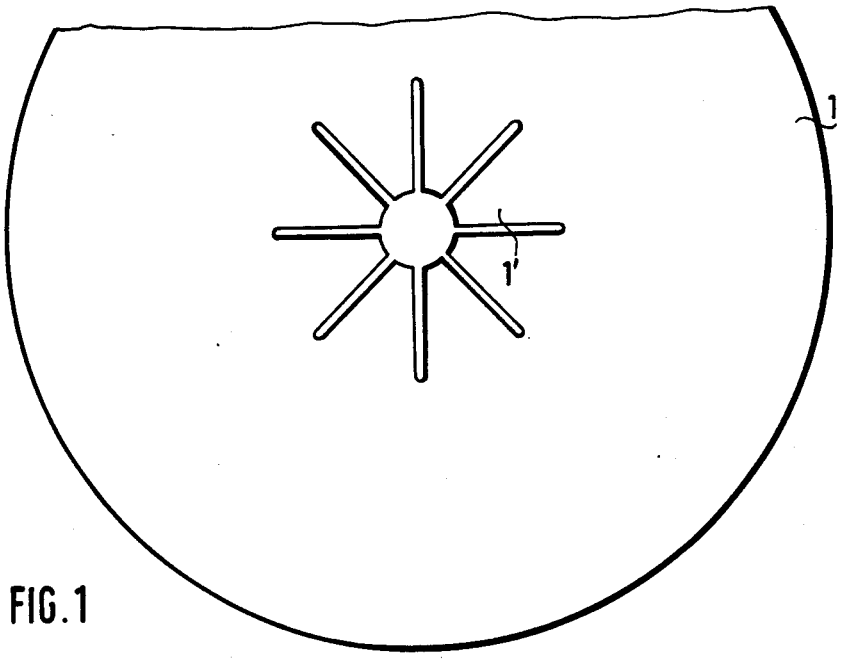
FIG. 1 is a plan view on a grinding sheet for fastening in the center area thereof.

Referring now to the drawing wherein like reference numerals are used throughout the various views to designate like parts, and more particularly to FIG. 1, this figure illustrates a grinding sheet 1 that includes fastening lugs or tabs 1' in the center thereof (in this figure, only one of these lugs is designated with this reference numeral representative for all). The fastening tabs or lugs 1' are formed by star-shaped slots.

Figure 2:
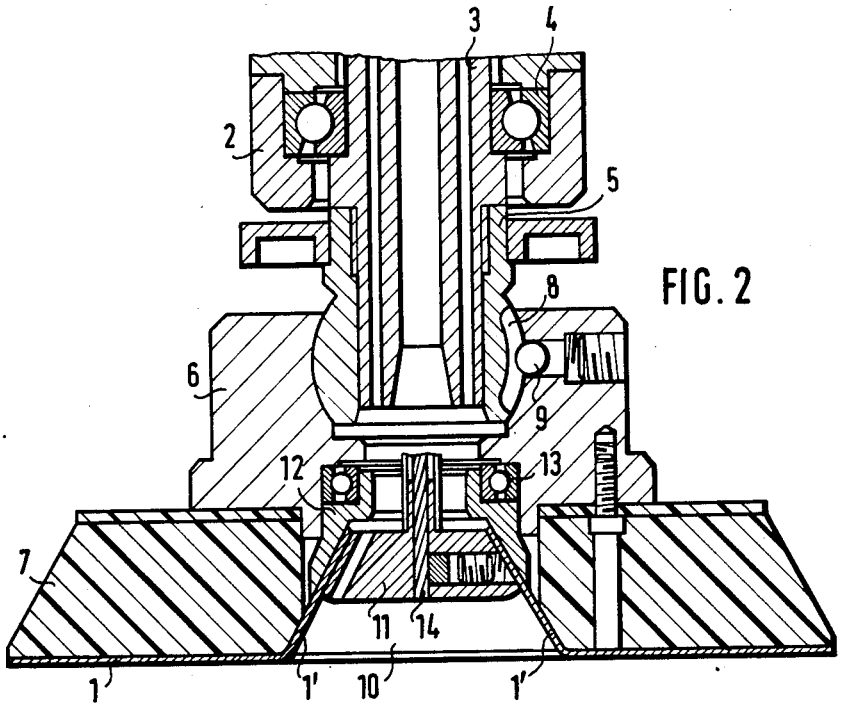
FIG. 2 is a cross-sectional view through the lower part of a grinding apparatus with a grinding disk and a grinding sheet secured thereon in accordance with the present invention.

FIG. 2 illustrates the lower section designated by reference numeral 2 of a grinding apparatus. A drive shaft 3 extends in the grinding apparatus. It is rotatably supported in the grinding apparatus 2 by way of roller bearings 4. At its lower end, the drive shaft 3 includes a structural member 5 which together with a structural member 6 forms a tumbling joint. The structural part 6 is again fixedly connected with the grinding disk 7. For transmitting the torque between the drive shaft 3 and the grinding disk 7, an axially extending guide groove 8 is provided in the structural member 5, into which engages a ball 9 retained in the structural member 6.

The further illustrations in FIG. 2 are, to the extent not further described hereinafter, non-essential for the present invention. Consequently, a detailed description thereof is dispensed with herein.

The grinding disk 7 consists of a soft material while a grinding sheet 1 corresponding to the grinding sheet illustrated in FIG. 1, is secured to its bottom side, i.e., on the side which later on faces the body surface to be rubbed down and polished. For this purpose, the grinding disk 7 is provided in its center area with a conically shaped recess or aperture 10, which widens in the direction toward the grinding surface. The fastening tabs or lugs 1' of the grinding sheet 1, which are flexible or bendable by reason of the construction of the grinding sheet, are bent into the aperture 10. They are clamped-in thereat between an actuatable pressure element 11 and a counter-abutment 12. The counter-abutment 12 is rotatably retained in the structural member 6 connected with the grinding disk 7 by way of a roller bearing 13. Additionally, the counter-abutment 12 includes an abutment surface for the fastening lugs or tabs 1'.

The pressure element 11 can be actuated from the grinding apparatus 2 by way of a Bowden cable 14 or the like. This type of actuation is not illustrated in detail in FIG. 2 since it can be conventionally realized in the most varied ways. Suitable therefor is, for example, a pneumatic cylinder arranged in the upper area of the grinding apparatus, whose piston is connected with the cable 14. Independently, however, of the type of actuating mechanism which is selected, the pressure element 11 must be rotatable with respect to the grinding apparatus 2. The pressure element 11 which is constructed as conical part, is pulled in the position illustrated in FIG. 2 into the aperture 10 by the cable 14 and thereby presses the fastening tabs or lugs 1' against the counter-abutment 12. As a result of the rotatable bearing support of the counter-abutment 12 with respect to the grinding disk 7, and that of the pressure element 11 with respect to the grinding apparatus, the clamped-in grinding sheet 1 can rotate independently of the grinding disk 7.

During the fastening of the grinding sheet 1, the grinding apparatus 2 is lowered onto the grinding sheet 1 lying in an appropriate installation, until the grinding disk 7 rests flush on the grinding sheet 1. Thereafter, the pressure element 11 is displaced downwardly and thereby pierces through the bendable fastening tabs or lugs 1'. Since the weight of the pressure element 11 itself will be inadequate for this purpose, further conventional actuating means for this displacement operation are provided in the grinding apparatus in addition to the cable 14. Once the pressure element 11 has pierced through the grinding sheet 1, the fastening tabs or lugs 1' return into their initial position by reason of their bendability and flexibility. The cable 14 now pulls the pressure element 11 again upwardly. The conical surfaces of the pressure element 11 thereby take along the fastening tabs or lugs 1' and as a result thereof, bend the same into the aperture 10. The fastening tabs or lugs 1' now abut at the abutment surface of the counter-abutment 12 and are finally clamped-in between the pressure element 11 and the counter-abutment 12 by a further pulling action on the cable 14.

The embodiments according to FIGS. 3 to 7 illustrate other constructions of the clamping elements. However, to the extent the parts are similar, the same reference numerals as in FIGS. 1 and 2 are used.

In FIG. 3 an expanding mandrel 15 forms the pressure element. The fastening tabs or lugs are thereby pressed in this embodiment into the aperture 10 by a ram or hollow cylinder 16. The ram or hollow cylinder 16 is guided in an interchange station independent of the grinding apparatus 2. In FIG. 3, the ram 16 which moves upwardly for the fastening, is illustrated in dash lines. During the fastening, the expanding mandrel 15 at first moves downwardly and then radially outwardly until it presses with its conical outer surfaces the fastening tabs or lugs 1' against the counter-abutment 12.

The expanding mandrel 15 itself is again rotatably supported in the grinding apparatus 2.

FIG. 4 illustrates an inflatable rubber bellows 17 as pressure element. The uprighting of the fastening tabs or lugs 1' is taken over again by a hollow cylinder 16. As soon as the hollow cylinder 16 has pressed the fastening tabs or lugs 1' into the aperture 10, the rubber bellows 17 is inflated so that together with the counter-abutment 12, it again clamps-in the fastening tabs or lugs 1'. The rubber bellows 17 itself is rotatably supported with respect to the grinding apparatus.

The pressure element according to FIG. 5 consists in this embodiment of several parts. At first, a conical disk 18 is arranged fixedly with respect to the counter-abutment 12. The disk axis coincides thereby with the axis of rotation of the grinding disk 7. A further conical disk 19 is provided displaceable above the conical disk 18, whereby the conical disk 19 is pressed onto the first disk 18 by way of a compression spring 20. The conical disks 18 and 19 are thereby so arranged to one another that their conical surfaces taper in the direction toward one another, i.e., that narrower disk sides face one another. As a result thereof, a ring-shaped V-cut is formed when the disks 18 and 19 contact each other. A ring spring 21 is placed into this V-cut. The ring spring 21 is thereby so dimensioned that it is expanded radially when the two conical disks 18 and 19 contact one another. Since the spring 20 presses on the conical disk 19, the spring 20 brings about the expansion of the spring 21 which in turn then presses again against the counter-abutment 12 under interposition of the fastening tabs or lugs 1'.

During the fastening according to this embodiment, initially a plunger or ram 22 presses the upper conical disk 19 upwardly against the force of the spring 20. The ring spring 21 can thereby become unstressed as is indicated in dash line in FIG. 5. The hollow cylinder 16 can thereupon bend the fastening tabs or lugs 1' into the aperture 10. If the plunger or ram 22 is now retracted, then the spring 20, as already mentioned, exerts a pressure by way of the conical disk 19 on the ring spring 21 which then expands and clamps-in the fastening tabs or lugs 1'. Also in this case, the parts forming the pressure element are again retained rotatable with respect to the grinding apparatus.

Figure 6:
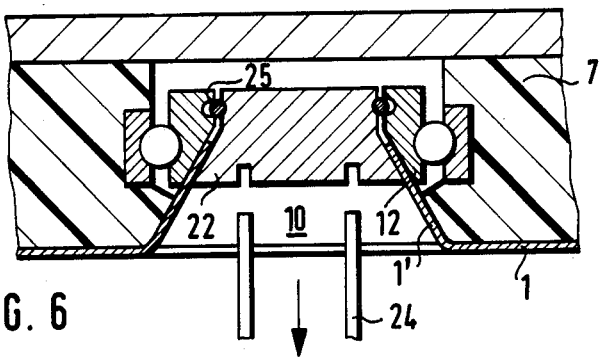
FIGS. 6 and 7 are partial cross-sectional views through two further modified embodiments in accordance with the present invention illustrating a type of fastening arrangement of the grinding sheet, in which the pressure element is introduced from below.
Figure 7:
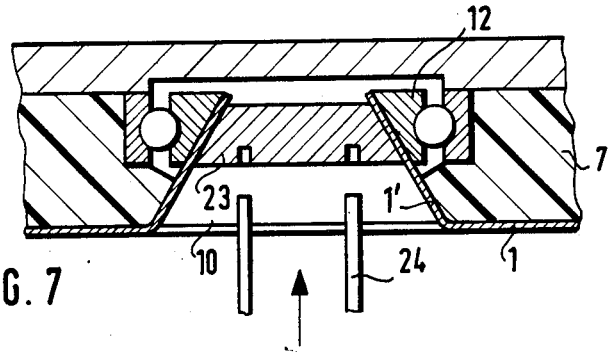

In FIGS. 6 and 7, a conical member 22, 23 is provided as pressure element which is adapted to be introduced from below. The conical members 22 and 23 are actuated by a further hollow cylinder 24 which is also guided in an interchange installation, not further illustrated. In FIG. 6, the conical member 22 is kept in its clamping position by a snap-in connection 25. Such snap-in connections are generally known in the art so that a detailed description thereof is dispensed with herein.

In FIG. 7, either the counter-abutment 12 or the conical member 23 is constructed as magnet, preferably as permanent magnet. The respectively other clamping element is then also formed of a magnetic material with good conductible properties. As soon as the conical member 23 is introduced into the aperture 10 by the hollow cylinder 24 and comes into proximity of the counter-abutment 12, it is attracted by the latter under interposition of the fastening tabs or lugs 1'.

Figure 8:
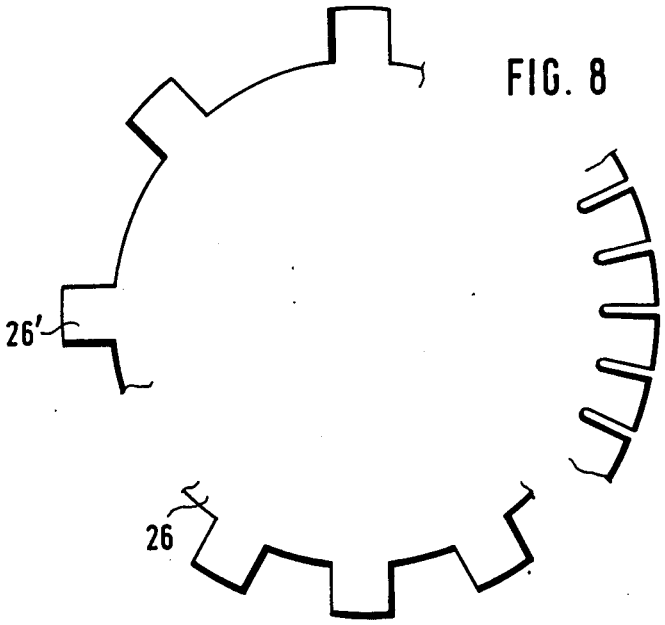
FIG. 8 is a plan view on a grinding sheet for the fastening thereof along the outside.

FIG. 8 illustrates a circular grinding sheet 26 with fastening tabs or lugs 26' distributed over the circumference. As can be seen from this figure, the distances between the individual fastening tabs or lugs 26' can be suitably selected dependent on requirements.

The grinding sheet 26 can be secured along the outer edge of a grinding disk 27.

Such a type of fastening is illustrated in FIGS. 9 and 10. In this embodiment, carrier or slide support members 28 are radially displaceably arranged at the grinding disk 27. FIGS. 9 and 10 illustrate these carrier or support members 28 merely schematically since their constructive details can be realized in different ways and provide no difficulties as known to those skilled in the art. The outer edge of the grinding disk 27 carries a ring spring 29 which is adapted to be expanded by the carrier or support members 28. In case of fastening, this clamping spring 29 clamps the fastening tabs or lugs 26' of the grinding sheet 26 against a counter-abutment, also not illustrated in detail. During the fastening, the carrier or support members 28 move outwardly whereas a hollow cylinder indicated by reference numeral 29', bends the fastening tabs or lugs 26' upwardly about the outer edge until they abut at the counter-abutment. Thereupon, the carrier members 28 move back so that the spring 29 is able to press the fastening tabs or lugs 26' against the counter-abutment.

FIGS. 11, 12 and 13 illustrate further possibilities of an external fastening of a grinding sheet 26 according to FIG. 8. In these embodiments, in lieu of the carrier members 28 according to FIGS. 9 and 10, pressure elements 30 are provided which have an angular cross section. These pressure elements 30 thereby act as pressure elements by means of their angular legs 30' and clamp the fastening tabs or lugs 26' against abutments 31. The abutments 31 are rotatably retained at the grinding disk 27. The uprighting of the fastening tabs or lugs 26' is again taken over by a hollow cylinder 29 schematically indicated in the drawing. The arrows 32 in the individual figures illustrate respectively the movement directions of the pressure elements 30. It should also be mentioned that the pressure elements 30 according to FIGS. 11, 12 and 13 and the carrier elements 28 according to FIGS. 9 and 10 must be rotatably supported with respect to the grinding apparatus, respectively, the grinding disk.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An installation for fastening a grinding sheet on a rotatable grinding disk of a grinding apparatus, in which the grinding sheet includes bendable fastening tabs and is operable to be secured on the grinding disk by clamping means by way of said fastening tabs, comprising clamping means for retaining the fastened grinding sheet relatively rotatable with respect to the grinding disk and having cooperative clamping elements also rotatable with respect to the disk.

2. An installation according to claim 1, in which a circularly shaped grinding sheet includes in its center area fastening tabs formed by star-shaped slots, and in which the center area of the grinding disk is provided with a funnel-shaped aperture which becomes wider in the direction toward the grinding surface, the aperture receiving the clamping means, between which the fastening tabs of the grinding sheet are adapted to be clamped-in, the clamping means being rotatably arranged with respect to the grinding disk and the grinding apparatus.

3. An installation according to claim 1, wherein the fastening tabs are arranged distributed over the circumference of a circularly shaped grinding sheet, are adapted to be uprighted along the edge of the grinding disk and are retained thereat by way of the clamping means carried by the grinding disk.

4. An installation according to claim 3, wherein the clamping elements are pressure elements angularly shaped in cross section which are distributed over the circumference of the grinding disk and are operable to be displaced radially, the pressure elements being matched to the position and number of the fastening tabs and cooperating with their angular legs with counter-abutments provided at the grinding disk.

5. An installation according to claim 3, wherein the fastening tabs of the grinding sheet are pressed against an abutment at the grinding disk by way of a ring spring means provided along the circumference of the grinding disk edge, and the ring spring means being operable to be expanded by radially displaceable carrier means arranged at the grinding disk.

6. An installation according to claim 1, wherein the clamping area of the clamping means is constructed elastically.

7. An installation according to claim 3, wherein the clamping area of the clamping means is constructed elastically.

8. An installation for fastening a grinding sheet on a rotatable grinding disk of a grinding apparatus, in which the grinding sheet includes bendable fastening tabs and is operable to be secured on the grinding disk by clamping means by way of said fastening tabs, comprising means including the clamping means for retaining the fastened grinding sheet relatively rotatable with respect to the grinding disk, in which the grinding sheet is circularly shaped and includes, in its center area, the fastening tabs formed by star-shaped slots, and in which the center area of the grinding disk is provided with a funnel-shaped aperture which becomes wider in the direction toward the grinding surface, the aperture receiving the clamping means, between which the fastening tabs of the grinding sheet are adapted to be clamped-in, the clamping means being rotatably arranged with respect to the grinding disk and the grinding apparatus, and said clamping means including an actuatable pressure element and a counter-abutment with abutment surfaces for the fastening tabs of the grinding sheet, comprising means for rotatably supporting the counter-abutment with respect to the grinding disk by way of a roller bearing means.

9. An installation according to claim 8, wherein the counter-abutment is rotatably supported on the grinding disk itself.

10. An installation according to claim 8, wherein the counter-abutment is rotatably supported on a structural member secured on the grinding disk.

11. An installation according to claim 8, in which the pressure element is formed as a conical member movable into the aperture of the grinding disk, and in which the counter-abutment is complementary to the conical shape of the pressure element, further comprising cable means provided in the grinding apparatus for retaining the conical member in the clamping position rotatable with respect to the grinding apparatus.

12. An installation according to claim 8, in which the pressure element is operable to be introduced as conical member from below into the aperture of the grinding disk, and wherein the pressure element is retained in the clamping position by snap-in means.

13. An installation according to claim 8, in which the pressure element is insertable as conical member from below into the aperture of the grinding disk, and wherein the pressure element is retained in the clamping position by magnetic forces

14. An installation according to claim 8, wherein the pressure element is constructed as expandable mandrel guided in and rotatably supported in the grinding apparatus.

15. An installation according to claim 8, wherein an inflatable rubber bellows arranged in the grinding apparatus forms the pressure element.

16. An installation according to claim 8, wherein the pressure element includes a first conical disk fixedly arranged with respect to the counter-abutment and a second conical disk which is displaceable with respect to the first conical disk against a spring force, the smaller sides of the conical disks facing one another, and a ring spring means acting on the counter-abutment being disposed between the conical disks.

17. An installation according to claim 8, wherein the clamping area of the clamping means is constructed elastically.

* * * * *